US007116306B2

(12) United States Patent
Lin

(10) Patent No.: US 7,116,306 B2
(45) Date of Patent: Oct. 3, 2006

(54) LIQUID CRYSTAL DISPLAY AND METHOD FOR OPERATING THE SAME

(75) Inventor: Hung-Lung Lin, Hsinchu (TW)

(73) Assignee: Winbond Electronics Corp., Hsinchu (TW)

( * ) Notice: Subject to any disclaimer, the term of this patent is extended or adjusted under 35 U.S.C. 154(b) by 395 days.

(21) Appl. No.: 10/438,917

(22) Filed: May 16, 2003

(65) Prior Publication Data

US 2004/0227716 A1 Nov. 18, 2004

(51) Int. Cl.
*G09G 3/36* (2006.01)

(52) U.S. Cl. ..... 345/99; 345/102; 345/104; 345/100

(58) Field of Classification Search ..... 345/87, 345/88, 99, 102, 204, 660, 212, 160; 358/451; 382/232; 713/322
See application file for complete search history.

(56) References Cited

U.S. PATENT DOCUMENTS 4,243,987 A * 1/1981 Bobick ..... 345/160
5,189,529 A * 2/1993 Ishiwata et al. ..... 358/451
5,555,322 A * 9/1996 Terai et al. ..... 382/232
5,576,738 A * 11/1996 Anwyl et al. ..... 345/212
5,852,429 A * 12/1998 Scheffer et al. ..... 345/100
5,889,694 A * 3/1999 Shepard ..... 365/105
5,935,253 A * 8/1999 Conary et al. ..... 713/322
6,046,735 A * 4/2000 Bassetti et al. ..... 345/204
6,054,976 A * 4/2000 Kubota et al. ..... 345/100
6,232,937 B1 * 5/2001 Jacobsen et al. ..... 345/87
6,232,946 B1 * 5/2001 Brownlow et al. ..... 345/98
6,873,320 B1 * 3/2005 Nakamura ..... 345/204
6,894,706 B1 * 5/2005 Ward et al. ..... 345/660
6,897,842 B1 * 5/2005 Gu ..... 345/90
6,965,365 B1 * 11/2005 Nakamura ..... 345/87
2002/0027541 A1 * 3/2002 Cairns et al. ..... 345/87
2002/0063675 A1 * 5/2002 Furuhashi et al. ..... 345/98
2002/0075211 A1 * 6/2002 Nakamura ..... 345/87
2002/0158823 A1 * 10/2002 Zavracky et al. ..... 345/87
2003/0137521 A1 * 7/2003 Zehner et al. ..... 345/589

* cited by examiner

*Primary Examiner*—Bipin Shalwala
*Assistant Examiner*—Prabodh Dharia
(74) *Attorney, Agent, or Firm*—Finnegan, Henderson, Farabow, Garrett & Dunner, L.L.P.

(57) ABSTRACT

A liquid crystal display includes a liquid crystal display panel having a plurality of pixels on a display line. A set of drivers drives a set of pixels, the set of drivers receiving display data and providing video signals to the set of pixels. A clock provides a clock signal to the set of drivers to latch the display data based on a frequency of the clock signal, and receives a feedback signal from the set of drivers prior to an end of the display data received by the set of drivers. A delay circuit stops the clock signal to the set of drivers, based on the feedback signal, after delaying for a first time period, that is no less than a predetermined time period between the feedback signal and the end of the display data received by the set of drivers.

30 Claims, 7 Drawing Sheets

LIQUID CRYSTAL DISPLAY AND METHOD FOR OPERATING THE SAME

FIELD OF THE INVENTION

This invention pertains to in general a liquid crystal display and method for operating the same, and more particularly, to a liquid crystal display that provides a feedback signal to a clock and method for operating the same.

BACKGROUND

A liquid crystal display ("LCD") device forms images by passing polarized light through small cells that vary their light-transmission characteristics according to electrical charges applied to the cells. Comparing with conventional cathode ray tube ("CRT") display devices, LCDs provide superior display quality, require lower operation voltage, consume less power, and occupy less space. As a result, liquid crystal display has become one of the major display technologies today. In fact, liquid crystal displays have been employed in various types of systems, such as laptop and desktop computers, personal digital assistants (PDAs), car navigation systems, projectors, and cellular phones.

A liquid crystal display panel generally includes an array of active pixel elements, such as transistors. Color filters accompanying individual displaying pixels enable a color display. As an example, a display array may include scanning lines formed horizontally along rows of pixels, and signal or data lines formed FINNEGAN vertically along columns of pixels. Individual transistors, such as thin-film transistors (TFTs), are formed at or near the intersections of the scanning lines and data lines. The transistors operate according to video signals supplied through the scanning and data lines to control how images are displayed by pixels.

In general, the major components of a liquid crystal display include an interface integrated circuit ("IC") for communicating with a source of video signals, a timing application-specific-integrated-circuit ("ASIC") controller, data drivers, scan drivers, a display panel with passive devices thereon, and a backlight unit. The interface IC communicates with and receives data from a data source, such as a motherboard in a desktop or laptop computer. The timing ASIC controller receives data from the interface IC and sends display data to the scan and data drivers. The data drivers generate video signals and deliver the video signals to the pixels in the display panel to drive the pixels to display video images. In some designs, the timing ASIC controller also provides a scaling function to enable switching among two or more different resolutions.

FIG. 1 illustrates the operation of a single data driver 10. Data driver 10 has a clock input, load input, and RGB (red-green-blue) data input. Data driver 10 has two cascade terminals that can be coupled to other data drivers or devices. Data driver 10 samples RGB data according to the clock input and generates signals, such as analog video signals for controlling the pixels. Taking a liquid crystal display for a laptop computer as an example, the size of the liquid crystal display may vary from 12 to 15 inches; the resolution may vary from 640×480 to 1600×1200; and the pixel clock for scanning lines may vary from 50 to 100 MHz.

Generally, a driver drives a certain number of channels or pixels but does not handle all the pixels on one display line. The number of pixels each driver drives is usually far smaller than the number of pixels that a liquid crystal display has in a single display line or scan line. Therefore, most liquid crystal displays employ a design of pooling together multiple data drivers and jointly operate the multiple data drivers to receive and process data. Generally, the multiple data drivers drive all of the pixels in the liquid crystal display in a line-by-line manner.

In driving a line of pixels, drivers usually operate jointly in a cascaded configuration. FIG. 2 illustrates conventional cascaded data drivers. The structure consists of "n" data drivers that are cascaded through their cascading terminals to drive all of the pixels of a liquid crystal display. Here, each data driver receives data to drive M channels or pixels, with each pixel acting as a complete RGB display unit. The total number of pixels in a display line is, therefore, the total number of pixels driven by all of the data drivers, namely n×M.

Under the cascaded configuration, driver #0 receives a first group of display data at the beginning of a display line. When driver #0 is full, it sends out a signal to the next driver, driver #1. Driver #1 then starts to receive the next set of display data. When driver #1 is full, it sends out a signal to a subsequent driver, driver #2. All the subsequent drivers, drivers #2 to #n−1, then conduct the same operation until the data for a full display line are received by the cascaded data drivers.

More specifically, driver 10 in FIG. 1 is triggered to operate by a clock signal through the clock-in terminal, by a triggering pulse through a cascade-in terminal, or by both. Based on this configuration, driver #0 in FIG. 2 latches a unit of display data, such as RGB image data, at each rising edge of the clock signal. After a number of clock cycles, the register array of driver #0 becomes full and driver #0 then sends a signal to the next driver, driver #1, through the cascade-out terminal of driver #0. Once driver #1 receives the signal through its cascade-in terminal, it starts to receive the next group of data until the register array of driver #1 becomes full.

Referring to FIG. 3, a conventional design of a liquid crystal display employs a single clock in a timing ASIC controller 12 to provide a clock signal to all of the data drivers, drivers #0 to #n−1. The conventional design requires a single clock to have the capability to drive several cascaded data drivers, such as eight, ten, twelve, or fourteen cascaded data drivers. The clock also has to deliver signals of sufficient level and strength to the clock input pin of each data driver. Due to the total amount of load imposed by the input load of all input pins, the clock source must have a high output load driving capability, a term known as "fan-out."

A clock with a higher fan-out, however, generates significant electromagnetic radiation that causes electromagnetic interference (EMI) with other devices or circuits. An excessive level of electromagnetic radiation may significantly interfere with the operation of other electronic devices to result in deteriorated performance of electronic devices within the proximity of the LCD. In addition, high EMI may also prevent the liquid crystal display from meeting certain safety and operational standards, such as the EMI standards established by the U.S. Federal Communications Commission (FCC).

To solve these problems, a dual or multiple clock design is developed and implemented in some liquid crystal displays. FIG. 4 provides an example of a dual clock design for a liquid crystal display. Data drivers #0 to #2n−1, which are used to be driven by a single clock in the conventional single-clock design, are now divided into two groups of equal numbers. Each group has "n" data drivers and is driven by a different clock. The illustrated system provides two clocks of smaller fan-out, pixel clocks 1 and 2, in the timing ASIC controller 14. These two clocks replace the single clock of a high fan-out illustrated in FIG. 3. The two clocks may provide continuous and synchronous clock signals to each group of data drivers. In general, the two clocks may operate to deliver synchronous signals and have overlapping signals near the center of the active "high" region of a valid display, as shown in FIG. 4B. Consequently, the two groups of drivers may alternate smoothly at a transitional point of data with the overlapping and synchronized clock signals.

The dual clock liquid crystal display system, however, requires each group of data drivers to drive an equal number of pixels, with each driver group being driven by one clock. The traditional dual clock system provides little flexibility in the design of the liquid crystal display, especially in the driving circuits. Also, the requirement of the traditional system considerably limits the possible implementations of data driver arrangements and creates significant obstacles for developing future generations of LCD systems. For example, current LCD system provides 800×600 pixels under the VGA mode, 1024×768 pixels under the SVGA mode, and 1280×1024 pixels under the SXGA mode. And future generations of LCD would provide an even larger number of pixels. The increased pixel dimension would make the traditional system less feasible.

SUMMARY OF THE INVENTION

Accordingly, the present invention is directed to a liquid crystal display and the method of operating a liquid crystal display that obviate one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the liquid crystal display and method particularly pointed out in the written description and claims thereof, as well as the appended drawings.

The present invention provides a liquid crystal display that includes a liquid crystal display panel, a set of drivers, a clock, and a delay circuit. The liquid crystal display panel has a plurality of pixels on a display line. The set of drivers drives the set of pixels. The set of drivers receives display data and provides video signals to the set of pixels. The clock provides a clock signal to the set of drivers for the set of drivers to latch the display data based on a frequency of the clock signal. Furthermore, the clock receives a feedback signal from the set of drivers prior to an end of the display data received by the set of drivers to determine when to stop the clock signal to the first set of drivers. The delay circuit is configured to stop the clock signal to the set of drivers based on the feedback signal. The delay circuit stops the clock signal to the set of drivers after delaying for a first time period that is no less than a predetermined time period between the feedback signal and the end of the display data received by the set of drivers.

In accordance with the present invention, another liquid crystal display is provided. The liquid crystal display includes a liquid crystal display panel, a first set of drivers, a second set of drivers, a first clock, and a second clock. The liquid crystal display panel has a plurality of pixels. The first set of drivers drives a first set of pixels on a display line. The first set of drivers receives display data and provides the first set of pixels with a first set of video signals. The second set of drivers drives a second set of pixels. The second set of drivers receives the display data and provides the second set of pixels with a second set of video signals. The second set of pixels is consecutive to the first set of pixels on the display line. The first clock provides a first clock signal to the first set of drivers for the first set of drivers to latch the display data based on a frequency of the first clock signal. In addition, the first clock receives a first feedback signal from the first set of drivers. The second clock provides a second clock signal to the second set of drivers no later than a first transition, which is an end of the display data received by the first set of drivers. The second set of drivers latches the display data based on a frequency of the second clock signal.

Also in accordance with the present invention, another liquid crystal display is provided. The liquid crystal display includes a liquid crystal display panel, at least two sets of drivers, two clocks, and a first delay circuit. The liquid crystal display panel has a plurality of pixels. The sets of drivers drive at least two sets of consecutive pixels in a display line, and the sets of drivers have a different number of drivers or drive a different number of pixels. The two clocks provide two clock signals, with each clock signal being provided to one of the sets of drivers for that set of drivers to latch display data based on a frequency of that clock signal. Furthermore, timing controller ASIS receives a feedback signal from a first set of drivers before an end of the display data received by the first set of drivers. The first delay circuit is configured to stop the first clock signal to the first set of drivers based on the first feedback signal, wherein the first delay circuit stops the first clock signal to the first set of drivers after delaying for a first time period, and the first time period is no less than a predetermined time period between the first feedback signal and the end of the display data received by the first set of drivers.

The present invention also provides a timing system for drivers of a liquid crystal display. The timing system includes a first clock and a first delay circuit. The first clock provides a first clock signal to a first set of drivers for driving a first set of pixels of a display line. The first set of drivers drives the first set of pixels by latching display data based on a frequency of the first clock signal and providing a first set of video signals to the first set of pixels. The first delay circuit operates to stop the first clock signal to the first set of drivers based on a first feedback signal received from the first set of drivers prior to an end of the display data received by the first set of drivers. In this embodiment, the first delay circuit stops the first clock signal to the first set of drivers after delaying for a first time period that is no less than a predetermined time period between the first feedback signal and the end of the display data received by the first set of drivers.

The present invention also provides a method for operating a liquid crystal display. The method includes providing a clock signal to a set of drivers for driving a set of consecutive pixels on a display line of the liquid crystal display; latching display data based on a frequency of the clock signal by the set of drivers; receiving a feedback signal from one of the drivers prior to a transition by the set of drivers for determining when to stop providing the clock signal to the set of drivers, the transition being an end of the display data received by the set of drivers; and providing video signals to the set of consecutive pixels by the set of drivers.

Also in accordance with the present invention, another method for operating a liquid crystal display is provided. The method includes providing a first clock signal to a first set of drivers for driving a first set of pixels in a display line;

latching the display data based on a frequency of the first clock signal by the first set of drivers until a first transition, the first transition being an end of the display data received by the first set of drivers; receiving a first feedback signal from the first set of drivers before the first transition to determine when to stop the first clock signal to the first set of drivers; providing a second clock signal to a second set of drivers driving the second set of pixels consecutive to the first set of drivers on the display line; latching the display data based on a frequency of the second clock signal until a second transition, the second transition being an end of the display data received by the second set of drivers; providing a first set of video signals to the first set of pixels by the first set of drivers; and providing a second set of video signals to the second set of pixels by the second set of drivers.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments of the invention and together with the description, serve to explain the principles of the invention.

DESCRIPTION OF THE EMBODIMENTS

Reference will now be made in detail to the present embodiments of the invention, examples of which are illustrated in the accompanying drawings. Wherever possible, the same reference numbers will be used throughout the drawings to refer to the same or like parts.

The present invention provides a liquid crystal display and a method for operating the liquid crystal display. The present invention allows different driver groups to have different number of drivers or drive different number of pixels. All the driver numbers for each group and pixels in each group can be updated when the circuit is running and such update do not require any firmware/software setting. Accordingly, the single ASIC design can fit many kinds and several generations of LCD modules. The present invention also allows a combination of two or more clocks and provides flexibility in the design of liquid crystal displays.

Figure 1:
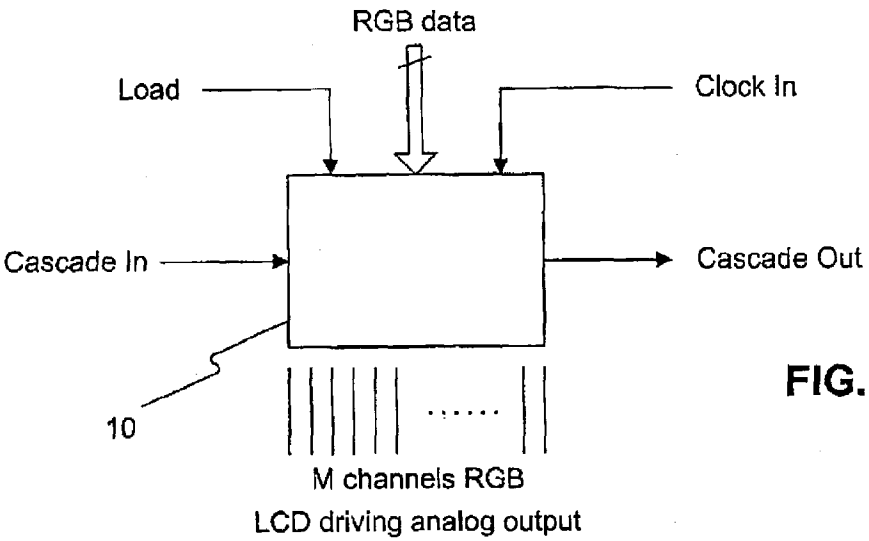
FIG. 1 (Prior Art)
FIG. 1 is a block diagram showing a conventional single data driver.
Figure 2:
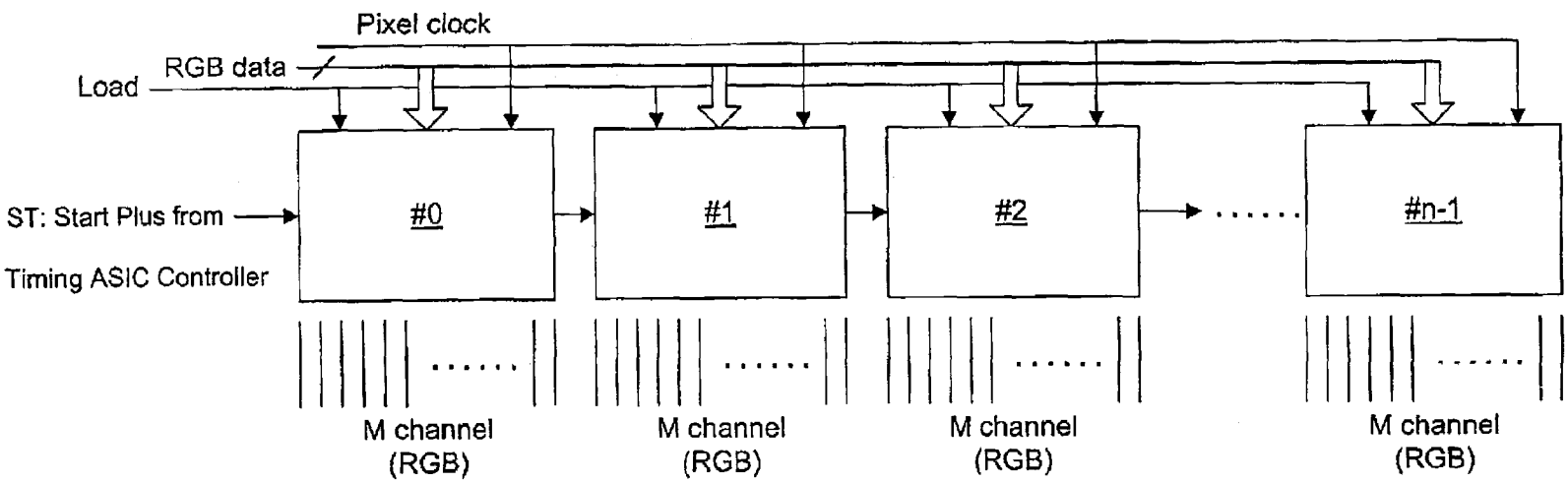
FIG. 2 (Prior Art)
FIG. 2 is a block diagram showing conventional cascaded data drivers.
Figure 3:
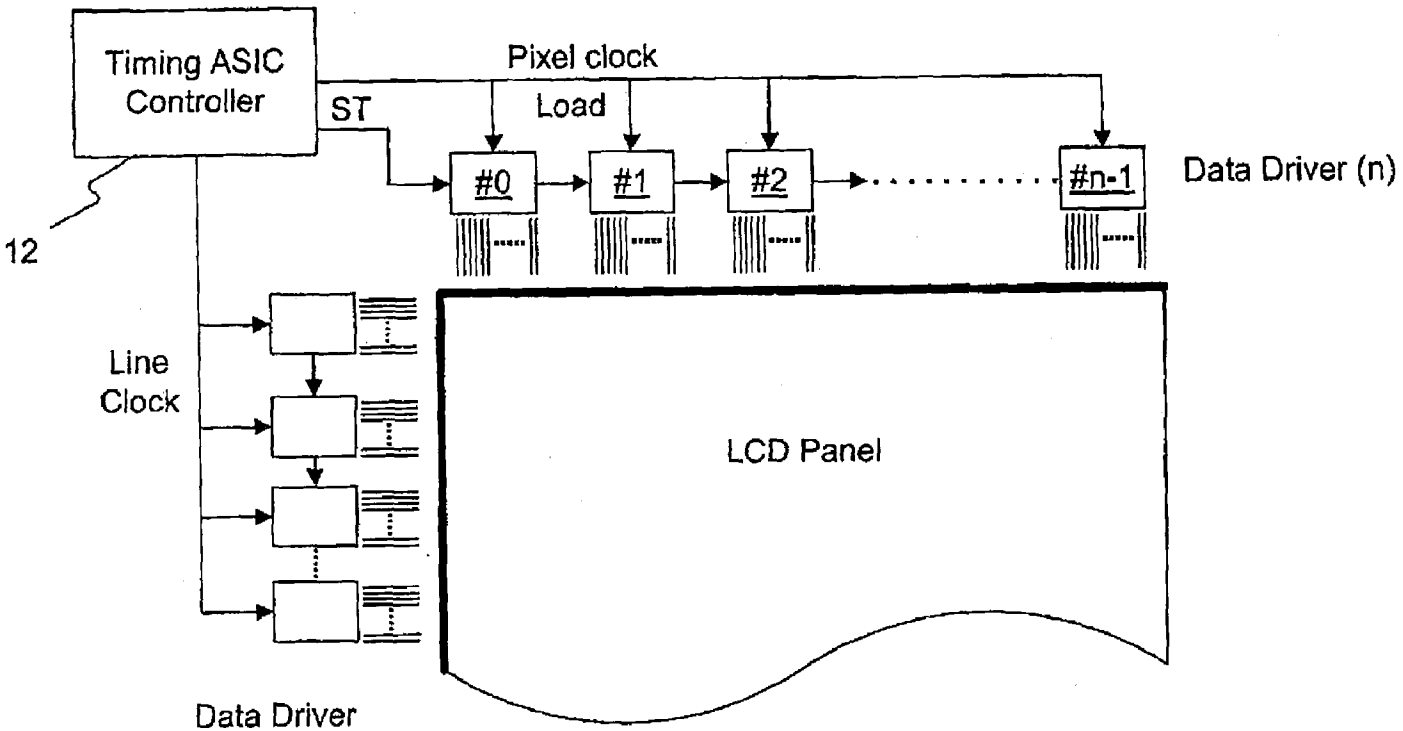
FIG. 3 (Prior Art)
FIG. 3 is a block diagram showing a conventional single clock design of a liquid crystal display.
Figure 4A:
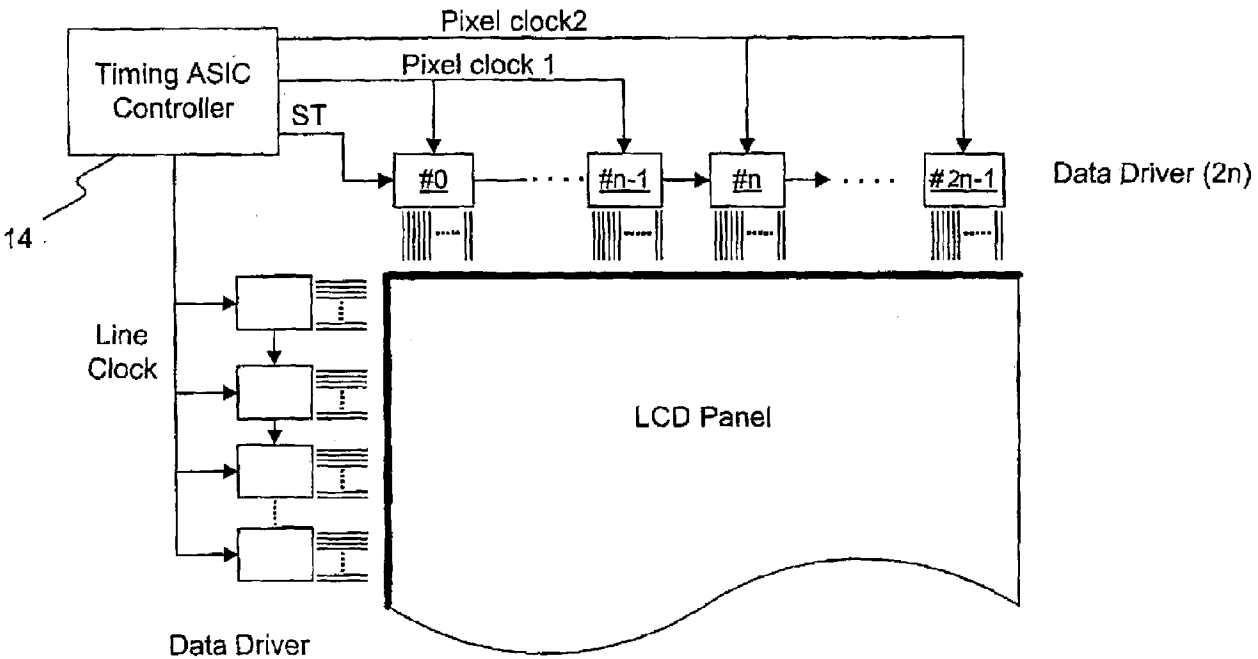
FIG. 4A (Prior Art)
FIG. 4A is a block diagram showing a conventional dual clock design of a liquid crystal display.
Figure 4B:
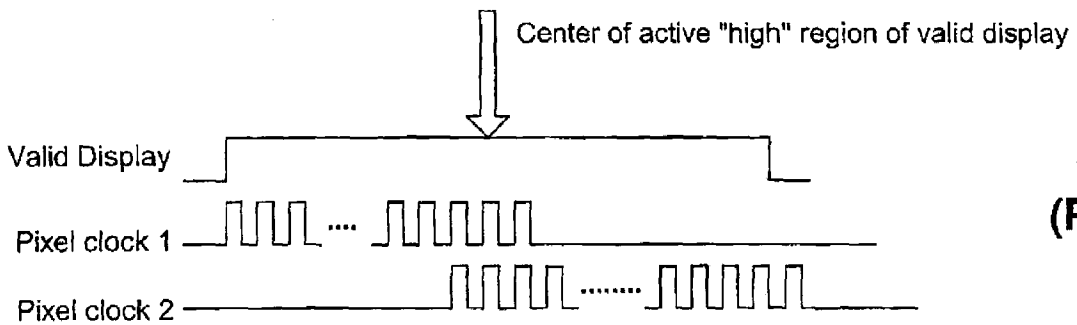
FIG. 4B (Prior Art)
FIG. 4B is a waveform diagram representing the operation of two clocks in a conventional dual clock liquid crystal display.
Figure 5A:
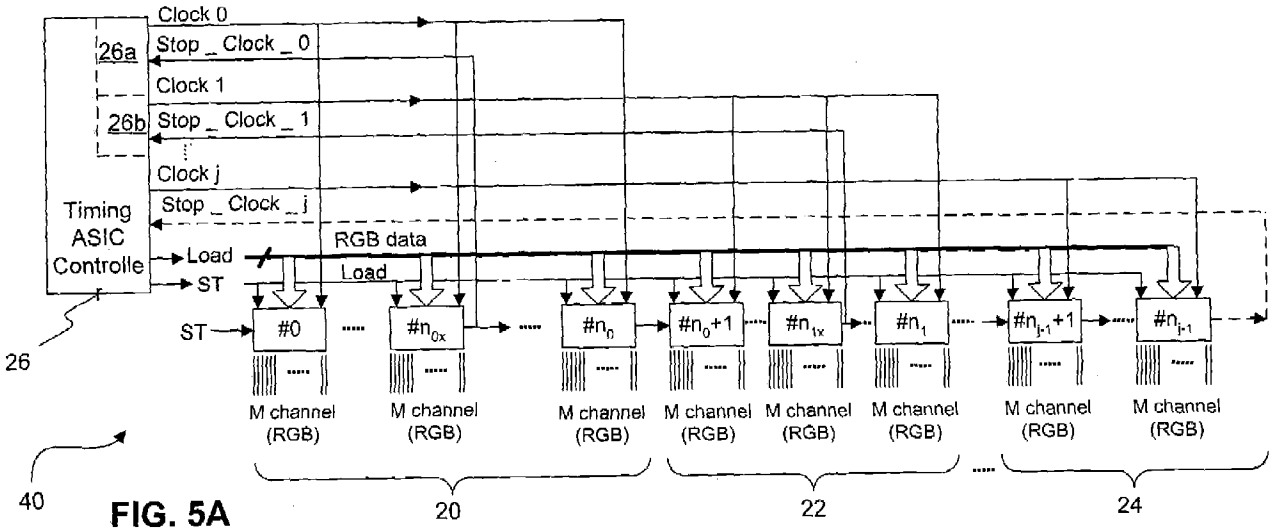
FIG. 5A is a block diagram showing the combination of three or more sets of drivers in a liquid crystal display consistent with one embodiment of the present invention.

FIG. 5A is a block diagram illustrating some of the components of a liquid crystal display 40 consistent with one embodiment of the present invention. Liquid crystal display 40 includes two or more sets of drivers, such as a first set of drivers 20 and a second set of drivers 22, and two or more clocks, such as a first clock 26*a* and a second clock 26*b*. First set of drivers 20 includes two or more drivers for driving a first set of pixels of liquid crystal display 40 by receiving display data and providing video signals to the first set of pixels.

Figure 6:
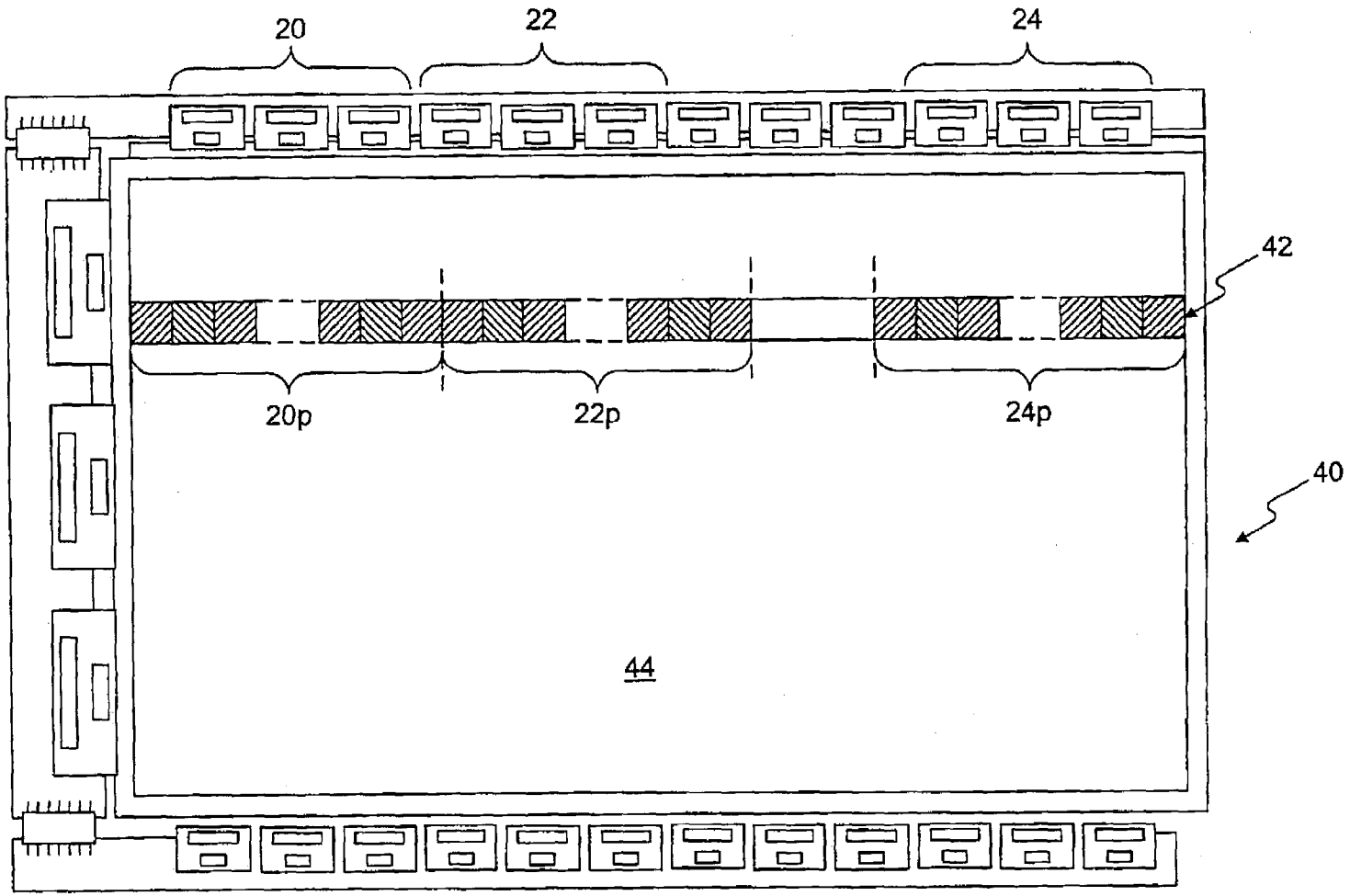
FIG. 6 is a schematic view of a liquid crystal display panel and data drivers consistent with one embodiment of the present invention.

FIG. 6 illustrates liquid crystal display 40. As an example, first set of pixels 20*p* includes a plurality of consecutive pixels that belong to a part of a single display line, such as a horizontal scan line or display line 42 on a liquid crystal display ("LCD") panel 44. Each driver of first set of drivers 20 is capable of driving a number of channels or pixels by supplying video signals to those pixels.

Generally, most of the LCD display panels drive the pixels in a horizontal line-by-line manner. Therefore, the drivers in FIGS. 5A and 6 can be data drivers that work jointly to drive a horizontal scan line. However, the liquid crystal display of the present invention can be modified for different applications. For example, a LCD display panel may be driven in a vertical line-by-line manner.

Similar to first set of drivers 20, second set of drivers 22 also includes two or more drivers for driving a second set of pixels 22*p* of liquid crystal display 40. Referring to FIG. 6, second set of pixels 22*p* includes a plurality of consecutive pixels that belong to a part of the same single display line 42 as first set of pixels 20*p*. Furthermore, second set of pixels 22*p* is consecutive to first set of pixels 20*p* along the same display line 42.

Depending on the design of the liquid crystal display, the drivers can be divided into two or more sets. The present invention allows different sets of drivers to have either the same or different numbers of drivers. Similarly, different sets of drivers may drive either the same or different numbers of pixels. FIG. 5A illustrates an example of a liquid crystal display that has more than three sets of drivers.

As an example for illustrating the operations of a liquid crystal display in the present invention, the drivers may drive the LCD panel 44 in a horizontal line-by-line manner. Therefore, after loading data for display line 42 and delivering video signals to the pixels in display line 42, the drivers then restart and repeat the same operations for the next display line. The next display line can be one line above or below display line 42. As discussed above, the drivers as illustrated can be data drivers for driving horizontal display lines. The liquid crystal display may have scan drivers to control and select a particular display line that is driven by the data drivers.

Figure 5B:
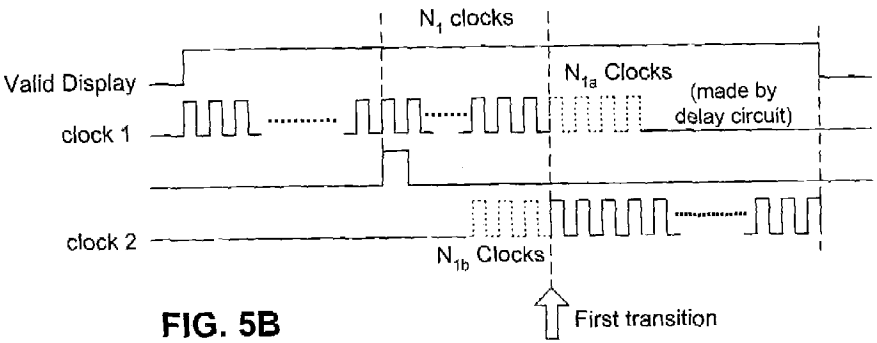
FIG. 5B is a waveform diagram representing the operation of the first and second clocks consistent with one embodiment of the present invention.

FIG. 5B shows a waveform diagram representing the operation of first clock 26*a* and second clock 26*b* in accordance with the present invention. Referring to FIG. 5B, first clock 26*a* provides a first clock signal to first set of drivers 20. First clock signal enables first set of drivers 20 to receive data according to the frequency of the clock signal and latch a unit of data at each clock cycle. For a color liquid crystal display, a unit of data includes a set of data for a display pixel that displays RGB information. In general, the drivers may have latches to sequentially store the received data. In one embodiment, first clock 26*a* starts to provide the first clock signal upon an initiation point, which is the beginning of display data received for display in a display line. As an example, the initiation point may be identified with the rising edge of a valid display signal for the liquid crystal display device. As illustrated in FIG. 5B, the valid display signal can be a signal that identifies, by remaining in a logically "high" state, the period within which the data for the entire display line is to be transmitted or received.

Referring to FIG. 5A, when the last driver of first set of drivers 20, driver #$n_0$, has received all the display data that it can manage and reaches an end of display data received by first set of drivers 20, it sends a signal to the first driver of second set of drivers 22, driver #$n_0$+1. The first driver of second set of drivers 22 then starts to receive the next group of display data in order to drive the corresponding pixels, namely a group of pixels driven by second set of drivers 22. The first driver of second set of drivers 22 may also initiate its operation after being triggered by the second clock signal.

The LCD system of the present invention also provides a first feedback signal that allows the system to identify the timing of a first transition before the first transition arrives. In one embodiment, the first transition is defined as the transition between the data for first set of pixels 20*p* and the data for second set of pixels 22*p*, or as the end of data for first set of pixels 20*p*. By receiving the first feedback signal, the system may locate the first transition by determining the number of clock cycles remaining, or the number of pixels remaining, before reaching the first transition. The first feedback signal therefore allows the system to identify when to stop providing the first clock signal to first set of drivers 20.

In the present invention, a driver of first set of drivers 20 provides the feedback signal. For example, if first set of drivers 20 has six (6) drivers, the system receives a feedback signal from the cascade-out terminal of one of the drivers, but not the sixth driver. The feedback signal from any of the first five drivers gives the system an early notice of when the first transition, or the end of display data received by the sixth driver, will arrive. A feedback signal from the sixth driver will come at the first transition and cannot provide an earlier notice before the first transition.

In one example, the system receives a feedback signal from the cascade-out terminal of the fourth driver. When the fourth driver becomes full and sends out a feedback signal, the system can determine how many more units of display data can be accepted by first set of drivers before reaching the first transition. In this example, the number of data units or clock cycles remaining equals the total number of pixels that will be driven by the fifth and sixth drivers. Therefore, the feedback signal from the cascade-out terminal of one of the drivers in first set of drivers 20 enables the system to predict, or to locate in advance, when the first transition will arrive, and accordingly when to stop providing the first clock signal to first set of drivers 20. The system may also be configured to receive more than one feedback signal from the more than one driver of first set of drivers 20.

Upon arriving at the first transition, the LCD system stops providing the first clock signal to first set of drivers 20 in one embodiment of the present invention. At this time, first set of drivers 20 have received all the data for first set of pixels 20*p*. Second clock 26*b* provides a second clock signal to second set of drivers 22 upon the first transition. Right after the first transition, second set of drivers 22 starts to receive the next set of display data for second set of pixels 22*p*.

The LCD system of the present invention, therefore, allows two or more sets of drivers to operate with two or more clocks in a continuous and synchronized manner. The present invention also provides a synchronous design by providing two or more clocks operating in phase and at the same frequency. First set of drivers 20 receives data for first set of pixels 20*p* during a period between the beginning of data transmission and the first transition, or namely the end of display data for first set of drivers 20. Second set of drivers 22 receives data for second set of pixels 22*p* during a period between the first transition and a second transition, or namely the end of display data for second set of drivers 22. The end of display data for second set of drivers 22 is the end of data for a display line if the LCD system has only two sets of drivers, as discussed below.

FIGS. 5A and 6 illustrate examples where the drivers are divided into three or more sets. Second set of drivers 22 operates in a manner similar to first set of drivers 20 in systems having three or more sets of drivers. In this embodiment, a LCD system receives a second feedback signal from second set of drivers 22 to locate a second transition prior to the second transition. The second transition is defined as the transition between data for the second set of pixels and data for the next set of pixels, or as the end of display data for second set of pixels 22*p*.

By receiving the second feedback signal, the system locates the second transition by determining the number of clock cycles remaining, or the number of pixels remaining, before reaching the second transition. As discussed above, the system obtains a feedback signal from the cascade-out terminal of one of the drivers in second set of drivers 22, except the last driver. The second feedback signal that comes before the second transition enables the system to predict or locate when the second transition will arrive and when to stop providing the second clock signal to second set of drivers 22.

Upon arriving at the second transition, second clock 26*b* stops providing the second clock signal to second set of drivers 22. At this time, the drivers in second set of drivers 22 have received all the data for the second set of pixels. The next clock, or alternatively, first clock 26*a*, then provides a clock signal to the next set of drivers upon the second transition. The next set of drivers starts to receive the next set of data for the next set of pixels. The present invention allows a liquid crystal display with three or more sets of drivers to operate with two clocks. Because the clocks may operate in an alternate manner, a LCD system with three or more sets of drivers can share two clocks without creating additional load to the two clocks. Therefore, the number of clocks may not necessarily depend on the number of sets of drivers for a LCD system.

Figure 7A:
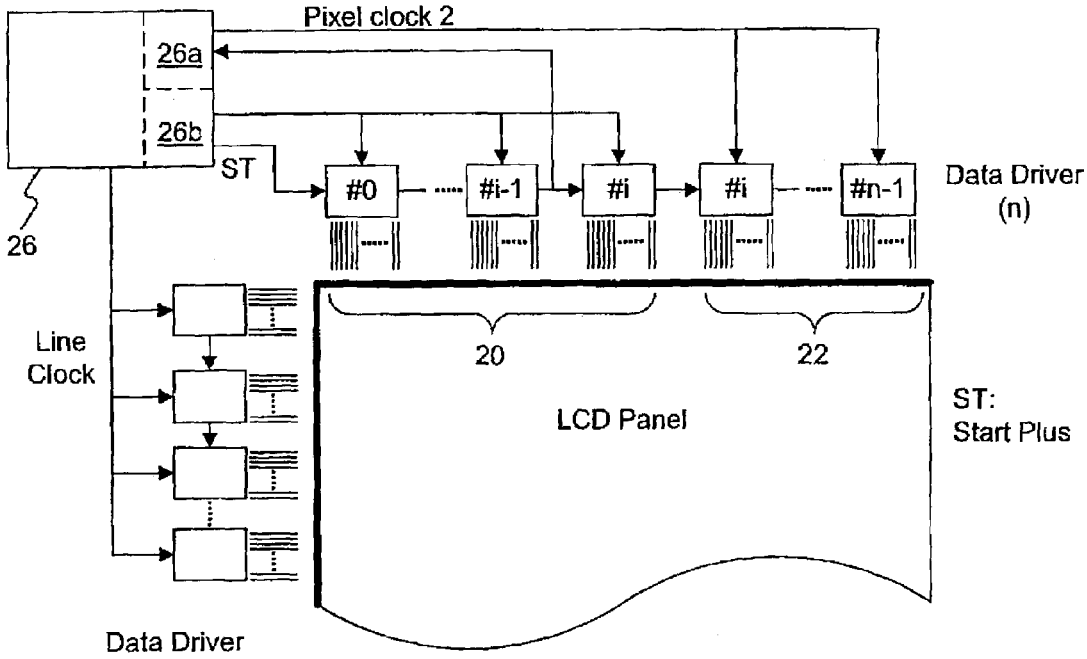
FIG. 7A is a block diagram showing the combination of two sets of drivers and two clocks in a liquid crystal display consistent with one embodiment of the present invention.

The LCD system of the present invention configures the last set of drivers in a slightly different manner. Referring to FIG. 7A, a LCD system divides the drivers into two sets, first set 20 and second set 22, and provides two clocks 26*a* and 26*b*. In this embodiment, second set of drivers 22 is the last set of drivers. Therefore, the display data transmission process for a display line ends at the last driver of the second set of drivers. Accordingly, the system configures and controls second clock 26*b* to stop providing the second clock signal upon the end of data for the display line. After the video signals in the drivers are transmitted to drive the pixels, the system then resets the drivers in order to perform similar operations for the next display line.

The stopping point for the second clock may be identified, as a first example, by a feedback signal from the cascade-out terminal of a driver where the data for display line 42 ends, mostly the last driver of second set of drivers 22. FIG. 5A illustrates an example where a feedback signal is obtained from the cascade-out terminal of the last driver of the last set of drivers. Alternatively, the stopping point of second clock 26*b* may be located before the stopping point arrives. As a second example, the system receives a feedback signal from the cascade-out terminal of one of the drivers of second set of drivers 22, except the last driver. As discussed above, the feedback signal enables the system to identify the stopping point before the data for display line 42 ends. The system identifies the stopping point based on the system information regarding the number of remaining pixels or clock cycles between the feedback signal and the end of display data for the display line.

As another example, the LCD system uses a counter to identify the end of data for a display line. The counter counts the number of clock cycles passed or the number of data units transmitted to the drivers. Once the number counted equals the total number of clock cycles or of data units for the entire display line, which is usually a predetermined number, the system identifies the stopping point. The system then stops the clock at the last set of drivers and generates a line reset signal. As a result, the system does not need to obtain a feedback signal from the drivers of second set of drivers 22. As a fourth example, the end of data for a display line may be identified with the falling edge of the valid display signal for the display line, as illustrated in 7B.

As an alternative to the design with two sets of drivers, FIG. 5A illustrates a system with three or more sets of drivers. Last set of drivers 24 in FIG. 5A operates in the same manner as second set of drivers 22 in the design of FIG. 7A. For example, a LCD system with three or more sets of drivers identifies the stopping point by a signal from the driver where data for display line 42 ends, generally the last driver of last set of drivers 24. Alternatively, the system may have a feedback signal from the cascade-out terminal of one of the drivers of last set of drivers 24, except the last driver. Furthermore, the end of data for a display line may be provided by a counter, or identified with the falling edge of the valid display signal for display line 42.

Figure 7B:
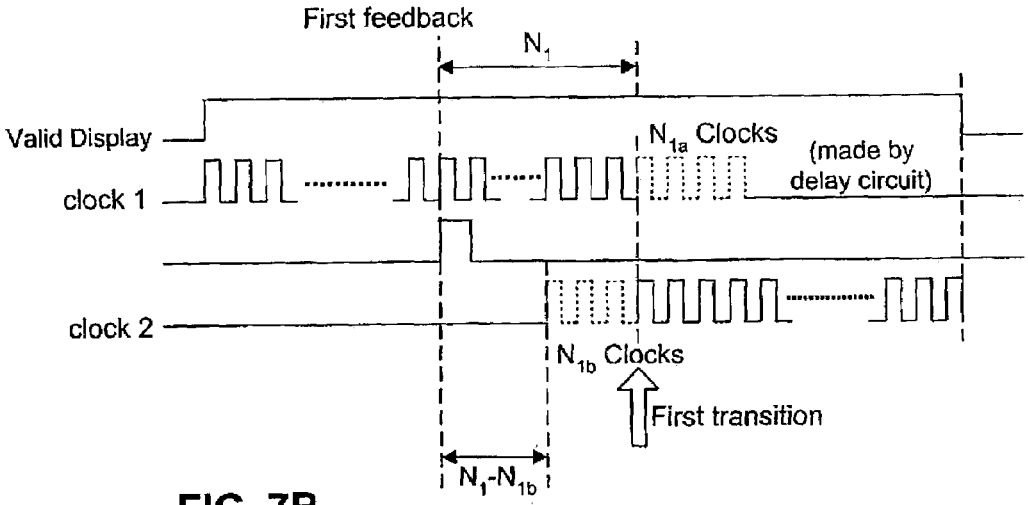
FIG. 7B is a waveform diagram representing the operation of the first and second clocks and a first feedback signal consistent with one embodiment of the present invention.

The LCD systems of the present invention may modify the starting and ending points for sending a clock signal to accommodate alternative designs or special demands of various systems. Referring to FIG. 7B, the LCD system sends additional cycles of clock signal to first set of drivers 20 after the first transition. For example, the system provides additional $N_{1a}$ cycles of clock signal to first set of drivers 20 after the first transition. In addition, the system may provide extra cycles of clock signal to second set of drivers 22 before the first transition. For example, the system may provide additional $N_{1b}$ cycles of clock signal to second set of drivers 22 before the first transition. Similarly, these pre-transition and post-transition clock signals may also be provided to other sets of drivers in the LCD system. For example, additional $N_{2b}$ cycles (not shown) of post-transition clock signal may be sent to second set of drivers 22 after the second transition.

Referring to FIG. 5A, in one embodiment, first and second clocks 26*a* and 26*b* are incorporated within a timing ASIC controller 26. Referring to FIG. 7B, the first feedback signal is received $N_1$ clocks before the first transition. The system in this example provides a post-transition clock signal by first clock 26*a* to first set of drivers 20, and provides a pre-transition clock signal by second clock 26*b* to second set of drivers 22. The system continues to provide the first clock signal from first clock 26*a* until $N_{1a}$ clock cycles after the first transition. The system starts sending signals from second clock 26*b* at $N_{1b}$ clock cycles before the first transition. The system, therefore, starts the second clock signal after $(N_1-N_{1b})$ clock cycles from receiving the first feedback signal, and stops the first clock signal after $(N_{1a}+N_{1b})$ clock cycles from the time the second clock 26*b* starts.

Figure 8A:
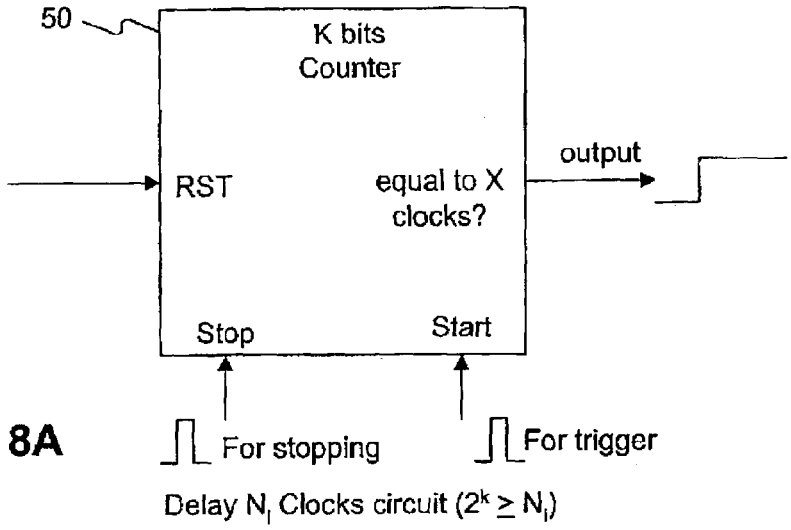
FIG. 8A is a block diagram of a delay circuit consistent with one embodiment of the present invention.
Figure 8B:
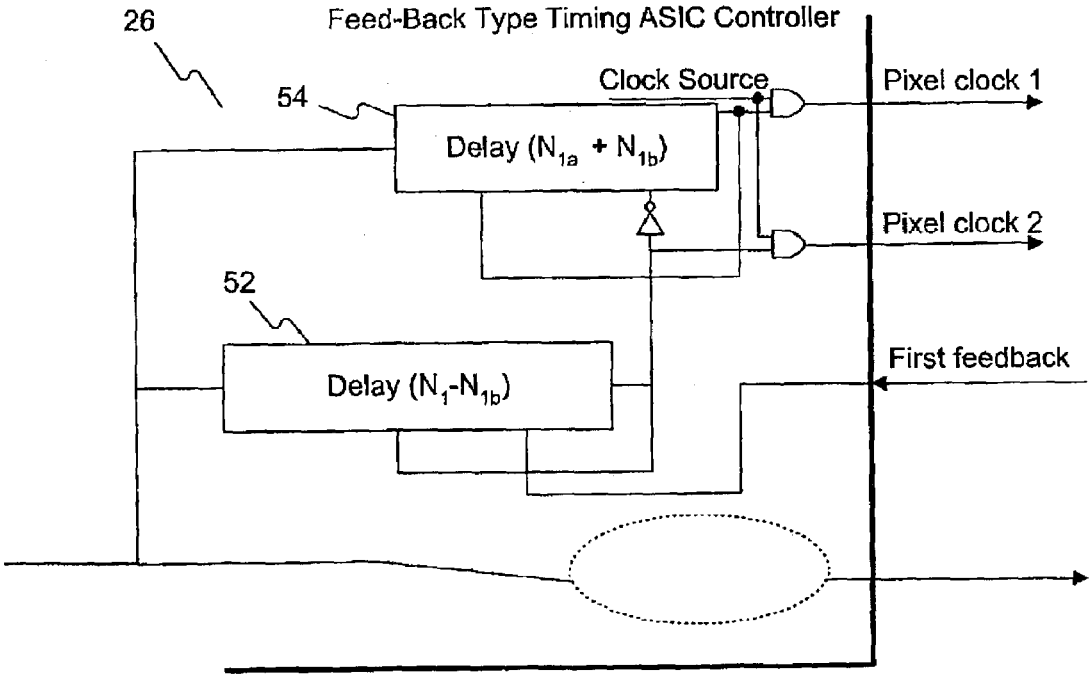
FIG. 8B is a block diagram showing two delay circuits in a dual clock liquid crystal display consistent with one embodiment of the present invention.

FIGS. 8A and 8B illustrate one way of implementing the present invention with delay circuits. Referring to FIG. 8A, the system includes a delay circuit 50 that provides a delay for a prescribed number of clock cycles. This exemplary delay circuit 50 has one output terminal and three input terminals, reset, stop, and start. Delay circuit 50 includes a counter to count the prescribed cycles. Once delay circuit 50 is initiated by a signal sent to the start terminal of delay circuit 50, delay circuit 50 will send out a signal through the output terminal after a predetermined number of clock cycles (X clock cycles) have passed.

Referring to FIG. 8B, a delay circuit 52 with $(N_{1-N1b})$ clock cycles of delay is provided to trigger the start of the second clock. A delay circuit 54 with $(N_{1a}+N_{1b})$ clock cycles of delay is coupled with delay circuit 52 in order to trigger the stop of the first clock. According to the clock signal diagram in FIG. 7B, the system starts the second clock after $(N_1-N_{1b})$ clock cycles from receiving the first feedback signal, and stops the first clock after $(N_{1a}+N_{1b})$ clock cycles from the time the second clock starts. As shown in FIG. 8B, delay circuit 52 receives the first feedback signal and triggers second clock 26*b* after $(N_1-N_{1b})$ clock cycles from receiving the first feedback signal. Delay circuit 54, with a starting signal from delay circuit 52 after $(N_1-N_{1b})$ clock cycles from the first feedback signal, counts $(N_{1a}+N_{1b})$ clock cycles and outputs a signal to stop the first clock after $(N_1+N_{1a})$ clock cycles from the first feedback signal.

FIG. 8B illustrates the embodiment where pre-transition and post-transition signals are provided. In the embodiment where no pre-transition and post-transition signal is provided, each of $N_{1a}$ and $N_{1b}$ is zero in FIG. 7. As a result, delay circuit 52 receives the first feedback signal and triggers second clock 26*b* at the first transition, or namely $N_1$ clock cycles after receiving the first feedback signal. Delay circuit 54 is not needed because first clock 26*a* stops providing the first clock signal to first set of drivers 20 at the first transition, or at the same point where the second clock signal is provided to second set of drivers 22. The same delay circuit 52 used to start the second clock signal, therefore, may be used to trigger first clock 26*a* to stop providing the first clock signal to first set of drivers 20.

The present invention provides a liquid crystal displays and method for operating a liquid crystal display. As illustrated by the aforementioned embodiments, the present invention provides a synchronous design that allows the combination of drivers in sets of the same or different numbers or in sets that drive the same or different number of pixels or channels. The system and method of the present invention also accommodate various designs, including any system with two or more clocks and two or more sets of drivers.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A liquid crystal display, comprising:

a liquid crystal display panel having a plurality of pixels on a display line;

a set of drivers for driving a set of pixels, the set of drivers receiving display data and providing video signals to the set of pixels;

a clock for providing a clock signal to the set of drivers to latch the display data based on a frequency of the clock signal, wherein the clock receives a feedback signal from the set of drivers prior to an end of the display data received by the set of drivers; and a delay circuit for stopping the clock signal to the set of drivers based on the feedback signal, wherein the delay circuit stops the clock signal to the set of drivers after delaying for a first time period, the first time period being no less than a predetermined time period between the feedback signal and the end of the display data received by the set of drivers.

2. The liquid crystal display as claimed in claim 1, wherein the clock starts providing the clock signal to the set of drivers no later than a beginning of the display data received by the set of drivers.

3. The liquid crystal display as claimed in claim 1, wherein the clock starts providing the clock signal to the set of drivers at a rising edge of a valid display signal for the display line.

4. The liquid crystal display as claimed in claim 1, wherein the set of drivers provides a feedback driver to provide the feedback signal to the clock, the feedback driver being a driver of the set of drivers except a last driver of the set of drivers.

5. A liquid crystal display, comprising:

a liquid crystal display panel having a plurality of pixels;

a first set of drivers for driving a first set of pixels on a display line, the first set of drivers receiving display data and providing the first set of pixels with a first set of video signals;

a second set of drivers for driving a second set of pixels, the second set of pixels receiving the display data and providing the second set of pixels with a second set of video signals, the second set of pixels being consecutive to the first set of pixels on the display line;

a first clock for providing a first clock signal to the first set of drivers for the first set of drivers to latch the display data based on a frequency of the first clock signal, wherein the first clock receives a first feedback signal from the first set of drivers to determine when to stop providing the first clock signal to the first set of drivers; and a second clock for providing a second clock signal to the second set of drivers no later than a first transition, the first transition being an end of the display data received by the first set of drivers, the second set of drivers latching the display data based on a frequency of the second clock signal.

6. The liquid crystal display as claimed in claim 5, wherein the first clock receives the first feedback signal prior to the first transition.

7. The liquid crystal display as claimed in claim 5, wherein the second clock receives a second feedback signal from the second set of drivers prior to an end of the display data received by the second set of drivers.

8. The liquid crystal display as claimed in claim 5, wherein the second clock starts providing the second clock signal to the second set of drivers no later than the first transition, and stops providing the second clock signal to the second set of drivers no earlier than the end of the display data received by the second set of drivers.

9. The liquid crystal display as claimed in claim 5, wherein the second clock stops providing the second clock signal to the second set of drivers at an end of the display data for the display line.

10. The liquid crystal display as claimed in claim 9, further comprising a counter for identifying an end of the display data of the display line and stopping the second clock signal to the second set of drivers.

11. A liquid crystal display, comprising:

a liquid crystal display panel having a plurality of pixels;

at least two sets of drivers for driving at least two sets of consecutive pixels in a display line, wherein two of the sets of drivers have a different number of drivers;

two clocks for providing two clock signals, each clock signal being provided to at least one of the sets of drivers to latch display data based on a frequency of that clock signal, wherein a first clock of the two clocks receives a feedback signal from a first set of drivers before an end of the display data received by the first set of drivers; and a first delay circuit for stopping a first one of the two clock signals to the first set of drivers based on the feedback signal, wherein the first delay circuit stops the first clock signal to the first set of drivers after delaying for a first time period, the first time period being no less than a predetermined time period between the feedback signal and the end of the display data received by the first set of drivers.

12. The liquid crystal display as claimed in claim 11, wherein two of the sets of drivers drive a different number of pixels.

13. The liquid crystal display as claimed in claim 11, wherein the first clock starts providing the first clock signal to the first set of drivers no later than a beginning of the display data received by the set of drivers.

14. The liquid crystal display as claimed in claim 11, wherein the first set of drivers includes a feedback driver to provide the feedback signal, the feedback driver being a driver of the first set of drivers except a last driver of the set of drivers.

15. The liquid crystal display as claimed in claim 11, wherein a second clock of the two clocks starts providing a second clock signal of the two clock signals to a second set of drivers no later than the end of the display data received by the first set of drivers, and stops providing the second clock to the second set of drivers no earlier than an end of the display data received by the second set of drivers.

16. The liquid crystal display as claimed in claim 15, wherein the second clock stops providing the second clock signal to the second set of drivers at an end of the display data for the display line.

17. The liquid crystal display as claimed in claim 15, wherein the two clock signals are synchronized to have a same frequency and be in a same phase.

18. A timing system for drivers of a liquid crystal display, comprising:

a first clock for providing a first clock signal to a first set of drivers for driving a first set of pixels of a display line, the first set of drivers driving the first set of pixels by latching display data based on a frequency of the first clock signal and providing a first set of video signals to the first set of pixels;

a first delay circuit for stopping the first clock signal to the first set of drivers based on a first feedback signal received from the first set of drivers prior to an end of the display data received by the first set of drivers, wherein the first delay circuit stops the first clock signal to the first set of drivers after delaying for a first time period, the first time period being no less than a predetermined time period between the first feedback signal and the end of the display data received by the first set of drivers.

19. The timing system as claimed in claim 18, further comprising:

a second clock for providing a second clock signal to a second set of drivers for driving a second set of pixels consecutive to the first set of drivers on the display line, the second set of drivers driving the second set of pixels by latching the display data based on a frequency of the second clock signal and providing a second set of video signals to the second set of pixels; and a second delay circuit for starting the second clock signal to the second set of drivers based on the first feedback signal, wherein the second delay circuit starts providing the second clock signal to the second set of drivers after delaying for a second time period, the second time period being no more than the predetermined time period between the first feedback signal and the end of the display data received by the first set of drivers.

20. The timing system as claimed in claim 18, wherein the first clock and the second clock synchronize the first clock signal and the second clock signal to have a same frequency and be in a same phase.

21. A method for operating a liquid crystal display, comprising:

providing a clock signal to a set of drivers for driving a set of consecutive pixels on a display line of the liquid crystal display;

latching a display data based on a frequency of the clock signal by the set of drivers;

receiving a feedback signal from one of the drivers prior to a transition for determining when to stop providing the clock signal to the set of drivers, the transition being an end of the display data received by the set of drivers; and providing video signals to the set of consecutive pixels by the set of drivers.

22. The method as claimed in claim 21, wherein providing the video signals to the set of consecutive pixels comprises providing video signals to the set of consecutive pixels by the set of drivers after the display data for the display line ends.

23. The method as claimed in claim 21, wherein providing the clock signal to the set of drivers comprises providing the clock signal to the set of drivers no later than a beginning of the display data received by the set of drivers, and stopping the clock signal to the set of drivers no earlier than the end of the display data received by the set of drivers.

24. The method as claimed in claim 21, wherein providing the clock signal to the set of drivers comprises providing the clock signal to the set of drivers until the end of the display data for the display line.

25. The method as claimed in claim 21, wherein receiving the feedback signal from one of the drivers comprises receiving the feedback signal from a feedback driver that is a driver of the set of drivers except the last driver for the set of drivers.

26. A method for operating a liquid crystal display, comprising:

providing a first clock signal to a first set of drivers for driving a first set of pixels in a display line;

latching display data based on a frequency of the first clock signal by the first set of drivers until a first transition, the first transition being an end of the display data received by the first set of drivers;

receiving a first feedback signal from the first set of drivers before the first transition to determine when to stop the first clock signal to the first set of drivers;

providing a second clock signal to a second set of drivers driving the second set of pixels consecutive to the first set of drivers on the display line;

latching the display data based on a frequency of the second clock signal until a second transition, the second transition being an end of the display data received by the second set of drivers;

providing a first set of video signals to the first set of pixels by the first set of drivers; and providing a second set of video signals to the second set of pixels by the second set of drivers.

27. The method as claimed in claim 26, wherein providing the second clock signal to the second set of drivers comprises providing the second clock signal to the second set of drivers no later than the first transition.

28. The method as claimed in claim 26, wherein providing the second clock signal to the second set of drivers comprises providing the second clock signal to the second set of drivers until the display data for the display line ends.

29. The method as claimed in claim 26, further comprising counting the number of clock cycles passed for receiving the display data of the display line by a counter to determine the end of the display data received by the second set of drivers.

30. The method as claimed in claim 26, further comprising identifying a falling edge of a valid display signal for the display line to determine the end of the display data received by the second set of drivers.

* * * * *